US008491960B2

(12) United States Patent
Kiy

(10) Patent No.: US 8,491,960 B2
(45) Date of Patent: Jul. 23, 2013

(54) METHOD FOR PRODUCING RAISED PRINT USING DIMENSIONAL INK AND THERMOGRAPHIC POWDER

(75) Inventor: Michael Kiy, Winterthur (CH)

(73) Assignee: Vistaprint Technologies Limited, Hamilton (BM)

( * ) Notice: Subject to any disclaimer, the term of this patent is extended or adjusted under 35 U.S.C. 154(b) by 0 days.

(21) Appl. No.: 12/917,416

(22) Filed: Nov. 1, 2010

(65) Prior Publication Data

US 2012/0107580 A1 May 3, 2012

(51) Int. Cl.
*B05D 1/38* (2006.01)
*B05D 5/00* (2006.01)
*B05D 3/02* (2006.01)

(52) U.S. Cl.
USPC ..... 427/202; 427/261; 427/265; 427/288

(58) Field of Classification Search
USPC ..... 427/202, 261, 265, 288
See application file for complete search history.

(56) References Cited

U.S. PATENT DOCUMENTS

| | | | | |
|---|---|---|---|---|
| 2,955,035 | A | 10/1960 | Walkup et al. | |
| 4,698,504 | A | 10/1987 | Van Pelt | |
| 4,792,246 | A | 12/1988 | Van Pelt | |
| 5,126,186 | A * | 6/1992 | Cheek | 428/195.1 |
| 5,615,614 | A | 4/1997 | Van Pelt | |
| 5,627,578 | A * | 5/1997 | Weintraub | 347/101 |
| 5,699,743 | A * | 12/1997 | Ganz et al. | 101/488 |
| 5,903,712 | A * | 5/1999 | Wang et al. | 358/1.9 |
| 6,119,598 | A | 9/2000 | Reynolds et al. | |
| 2008/0159786 | A1 | 7/2008 | Tombs et al. | |
| 2010/0104336 | A1 | 4/2010 | Christopher et al. | |
| 2010/0159648 | A1 | 6/2010 | Tombs et al. | |

FOREIGN PATENT DOCUMENTS

| | | |
|---|---|---|
| EP | 0501396 | 9/1992 |
| EP | 0360798 B1 | 12/1992 |
| WO | 88/06974 | 9/1988 |
| WO | 01/33301 | 5/2001 |

OTHER PUBLICATIONS

International Search Report mailed on Jul. 13, 2012 for International Application No. PCT/IB2011/002932.

* cited by examiner

*Primary Examiner* — Frederick Parker
(74) *Attorney, Agent, or Firm* — Jessica Costa

(57) ABSTRACT

A method for producing a printed product with raised print includes receiving a prepress format document containing a plurality of flat ink color separations and at least one raised print color separation, printing onto a substrate the flat ink color separations using flat ink and the at least one raised print color separation using dimensional ink, allowing the flat and dimensional ink to dry, heating the inked substrate to a temperature that causes the applied dimensional ink to become sticky, applying thermographic powder to the heated inked substrate such that the thermographic powder sticks to the sticky dimensional ink, removing the thermographic powder from regions of the substrate where the dimensional ink is not applied, reheating the sheet to melt the thermographic powder, and cooling the sheet to result in a print product having both flat and raised printed content.

4 Claims, 2 Drawing Sheets

METHOD FOR PRODUCING RAISED PRINT USING DIMENSIONAL INK AND THERMOGRAPHIC POWDER

BACKGROUND OF THE INVENTION

The present invention relates generally to producing printed products with raised printing, and more particularly to digital thermographic methods, systems and products.

Raised print is often desired for such printed products as business cards, invitations, and placards due to the aesthetically pleasing texture and is often equated with high-quality and luxury. Desired haptics effects require a raised print thickness of approximately 50 microns. Traditional raised printing techniques that can achieve this thickness include screen printing and thermography.

Screen printing produces raised print by printing relatively viscous paint at elevated film build through screens/sieves. Thermographic powder can be applied to the wet ink, and the resulting print is first heated to melt the powder and then cooled, resulting in a raised print. Screen printing can yield a film build of greater than 100 microns but present technology requires a photographic pattern in order to transfer the desired structure and is thus limited to non-digital technologies.

Thermography produces raised print by applying thermographic powder to wet ink. The resulting print/powder combination is heated to melt the powder and then cooled to create a solid raised print. Thermography is a well-established raised printing technique that can be used to consistently achieve high quality raised print of desired thicknesses of greater than 100 microns. However, in some applications, such as high-volume printing, thermography may not be ideal. In traditional thermography, the printing press must deliver wet ink in order for the thermographic powder to stick. This can be disadvantageous, as wet sheets delivered by the printing press cannot be stacked prior to processing by the thermographic powder application unit. The desired manufacturing setup is therefore a dedicated printing press whose output directly feeds a thermography press, which receives sheets with wet ink, applies the thermographic powder, shakes or blows off the excess thermographic powder, heats and the cools the sheets. Thus, the full speed capacity of the offset printing press may not be realized as it is limited by the speed of the thermography press.

In addition, the manufacture of a printed product with both flat and raised print is a two-pass process—the first pass to print and dry the flat print followed by a second pass to print the wet ink in areas where thermographic powder is to stick and raised print is to appear. For printed products that include both non-raised print (CMYK) and raised print, the non-raised portion of the printed material is often printed first on a standard CMYK press or printer, and is then introduced to a thermography press to print the raised portions. This arrangement generally limits the paper size to relatively small sheets of paper/substrate due to registration issues. That is, if the flat print and raised print are printed in different machines, the raised print needs to be aligned within a very tight tolerance (e.g., +/−150 micrometers). This is very complicated for the large sheets (B1) that are desirable in mass production. While smaller sheets (e.g., letter- or A4-size sheets) may be used to improve the registration issues, use of smaller sheets may not take full advantage of the printing press capacity and may be unacceptable for the desired production efficiency.

As mentioned above, both screen printing and traditional thermography are non-digital technologies. For digital technologies, Scodix Ltd., headquartered in Rosh Ha'ayin, Israel, produces the Scodix1200™ UV DigitalEmbossing™ press, which produces raised print by printing a clear ink (or glue in combination with foil or coarse pigments for simulated embossed/metallic/glitter special effects) on a CMYK flat-printed sheet and directly curing the ink/glue by UV-irradiation. The Scodix system can achieve a 20-80 micron film build per layer in a 300 dpi resolution.

Another digital system is the Kodak Nexpress s3600, manufactured by Eastman Kodak Company of Rochester, N.Y. The Kodak Nexpress s3600 may include a Fifth Imaging Unit which applies clear dimensional ink during the CMYK printing process to specified areas of the printed product to produce a 3-dimensional appearance. The Nexpress has a single-pass advantage in that CMYK and raised print are produced by a single machine. However, achievable thickness results for the raised output produced by presses of this type using dimensional ink has been found to be in the range of 30 microns.

It would therefore be desirable to find a digital raised print solution that allows the desired raised print thickness achievable by thermography and screen-printing, and which allows printing of both full-color CMYK flat-print areas as well as raised print areas.

SUMMARY OF THE INVENTION

Thermographic techniques for producing high-quality raised-print products in mass production environment.

In an embodiment, a method for producing a printed product with raised print includes receiving a document containing CMYK and raised print color separations, printing the document onto a substrate using a dimensional ink printer which prints onto the substrate the CMYK color separations using flat ink and prints the raised print color separation with a dimensional ink, allowing the flat and dimensional inks to dry, heating the substrate to a temperature that causes the applied dimensional ink to become sticky, applying thermographic powder to the heated sheet such that the thermographic powder sticks to the sticky dimensional ink, removing the thermographic powder from regions of the substrate where the dimensional ink is not applied, reheating the sheet to melt the thermographic powder, and cooling the sheet to result in a CMYK plus raised print product.

In another embodiment, a raised print product includes a substrate having regions of raised print wherein, in the regions of raised print, a dimensional ink is layered on top of the substrate and a thermographic material is layered on top of the dimensional ink layer.

BRIEF DESCRIPTION OF THE DRAWINGS

A more complete appreciation of this invention, and many of the advantages thereof, will be readily apparent as the same becomes better understood by reference to the following detailed description when considered in conjunction with the accompanying drawings in which like reference symbols indicate the same or similar components, wherein.

DETAILED DESCRIPTION

Figure 1:
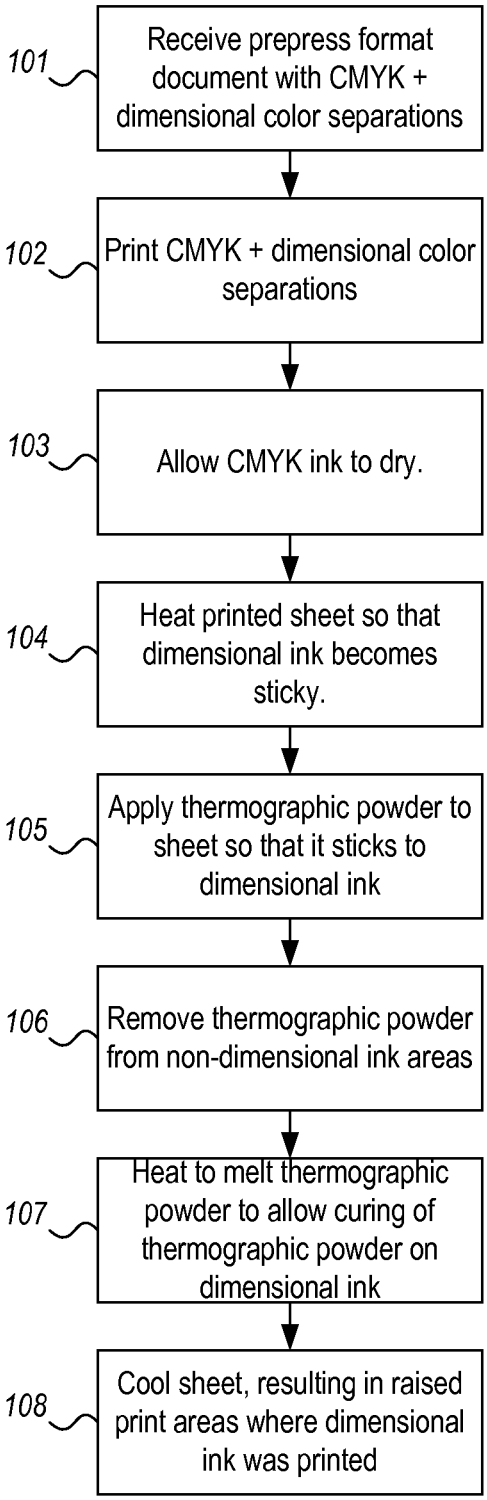
FIG. 1 is a flowchart of an exemplary method for producing a sheet having raised print.

Referring to FIG. 1, there is shown a flowchart outlining the steps of an exemplary embodiment of a process for producing raised print. First, a prepress format document containing the CMYK and raised print color separations are received (step 101). The CMYK is printed together with a dimensional ink in a dimensional ink press having a fifth imaging unit for printing the dimensional ink (step 102), such as the Kodak Nexpress s3600 equipped with a fifth imaging unit. Because the raised print regions are represented in the color separations as a dimensional ink separation, the dimensional ink is applied only in regions where the raised print should appear. The ink for each of the CMYK colors are allowed to dry (step 103). The dry sheets are then heated to a temperature that causes the applied dimensional ink to become sticky (step 104). Thermographic powder is then applied (step 105) and then blown off,or shaken away, or otherwised removed, so that the thermographic powder remains adhered only to the dimensional ink areas (step 106). The sheet is reheated (step 107) to melt the thermographic powder, and then cooled (step 108). The result is a CMYK plus raised print product. Notably, the height of the raised print is adjustable by the amount of dimensional ink plus amount of thermographic powder applied thereto.

Figure 2:
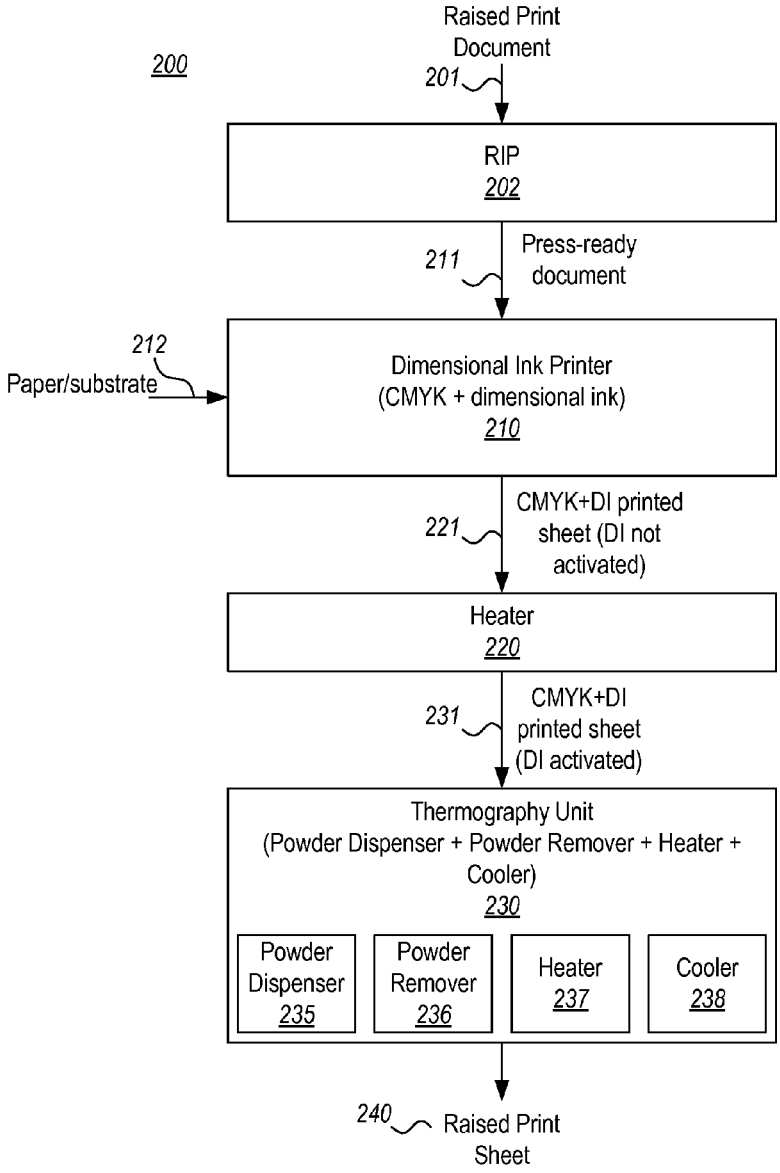
FIG. 2 is a block diagram of an exemplary embodiment of a system for producing a sheet having raised print.

FIG. 2 illustrates a system 200 for mass producing raised print products. As illustrated, a raster image processor (RIP) 202 receives a raised print document 201 in electronic form that includes a raised print layer. The RIP 202 rasterizes the document 201 into a bitmap image and separates the colors of the bitmap image to generate a press-ready document 211. The press-ready document 211 is one or more electronic files containing different films (in electronic representation) representing the color separation of each of the Cyan, Magenta, Yellow, Black, and dimensional inks.

The press-ready document 211 document (i.e., containing the electronic files containing the color separations) is then received by a dimensional ink printer 210 (such as the Kodak Nexpress s3600 with Fifth Imaging Unit), which prints the CMYK and dimensional ink layers, depositing dimensional ink onto areas of a sheet of paper or other substrate 212 where raised print should appear as indicated by the dimensional ink separation generated by the RIP 202.

The printed sheets 221 output by the dimensional ink printer 210 (including the CMYK colors and non-activated dimensional ink (DI)) are then conveyed to a heating unit 220. In an embodiment, the system implements a conveyor system which transports printed sheets output by the dimensional ink printer 210 to the heating unit 220. At the heating unit 220, the sheets are heated to a temperature sufficient to activate the dimensional ink (i.e., such that the dimensional ink gets sticky). This temperature will depend on the chemical properties of the dimensional ink used. In an embodiment, the dimensional ink is made substantially of Polyerster.

Once heated to the desired temperature, the sheet is transported to a thermography unit 230, which includes a powder dispenser 235, a powder removal unit 236, a heater 237, and a cooling unit 238. In operation, the DI-activated sheet 231 is first conveyed past the powder dispenser 235 which applies thermography powder to the heated sheets. In an embodiment, the thermographic powder is a fatty acid dimer based Polyamide resin powder having particle sizes of 70-250 microns and a melting point at approximately 228° F. (109° C.). The sheets are conveyed past a powder remover 236 such as a fan blower, a vibrating apparatus, a vacuum, etc. to blow/shake/vacuum the thermography powder off the non-sticky portions of the heated sheet. Thermographic powder sticks on the activated (sticky) dimensional ink only, and not on the exposed flat ink of the hot sheet.

The sheets are conveyed to a second heating unit 237, which once again heats the sheet to melt the applied thermography powder. (In an alternative embodiment, the first and second heating units 220 and 237 can be the same heating unit which is used for both functions.) The heating temperature will depend on the chemical properties of the thermographic powder used. In an embodiment, the heating unit 237 is heated to a temperature of between 700° F. (370° C.) and 1500° F. (815° C.) to quickly bring the temperature of the thermographic powder to and above its melting point of approximately 228° F. (109° C.). When the thermographic powder melts, they are removed from the heating unit 237 and conveyed past a cooling unit 238. The melted thermographic powder cools, forming a solid. After cooling, the result is a printed sheet 240 having both flat print areas and raised print areas.

Figure 3:
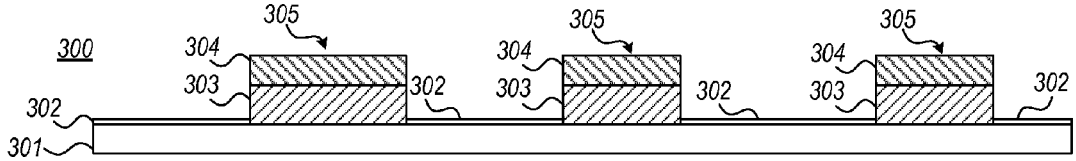
FIG. 3 is a cross-sectional view of a sheet having raised print that is produced according to principles of the invention.

FIG. 3 is a cross-sectional view of a raised print product 300 having flat print sections 302 and raised print sections 305 produced according to principles of the invention, in particular illustrating the product layer structure. As illustrative embodiment, the raised print product 300 includes a substrate 301 having flat ink regions 302 and raised print regions 305. As further illustrated, in the raised print regions 305, a layer of printed dimensional ink 303 is deposited over the substrate 301. In an embodiment, the deposited dimensional ink is a Kodak dimensional toner comprising 95% Polyester and some additives. As also illustrated in FIG. 3, deposited on top of the dimensional ink layer 303 is a layer of melted and solidified thermography powder 304. The flat ink regions of the sheet do not have dimensional ink or thermography powder deposited thereon.

What is claimed is:

1. A method for producing a printed product with raised print, comprising:

receiving a prepress format document containing a plurality of flat ink color separations and at least one raised print color separation;

printing the document onto a substrate using a dimensional ink printer which prints onto the substrate the plurality of flat ink color separations using flat ink and prints the at least one raised print color separation using dimensional ink;

allowing the flat and dimensional ink to dry;

heating the inked substrate to a temperature that causes the applied dimensional ink to become sticky;

applying thermographic powder to the heated inked substrate such that the thermographic powder sticks to the sticky dimensional ink;

removing the thermographic powder from regions of the substrate where the dimensional ink is not applied;

reheating the sheet to melt the thermographic powder; and cooling the sheet to result in a print product having both flat and raised printed content.

2. The method of claim 1, wherein the plurality of color separations comprises Cyan, Magenta, Yellow, and Black.

3. The method of claim 2, wherein the plurality of flat ink color separations and the raised print color separation are printed onto the substrate using a dimensional ink printer.

4. The method of claim 1, wherein the plurality of flat ink color separations and the raised print color separation are printed onto the substrate using a dimensional ink printer.

* * * * *